US006113111A

United States Patent [19]

Gierveld et al.

[11] Patent Number: 6,113,111

[45] **Date of Patent: *Sep. 5, 2000**

[54] SPORT DEVICE

[75] Inventors: Johan Gierveld, Wierden; Diederik Hendrik Alewijn Hol, Bennekom; Egbert Otten, Groningen, all of Netherlands

[73] Assignee: Gierveld Beheer B.V., Wierden, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/952,775

[22] PCT Filed: May 24, 1996

[86] PCT No.: PCT/NL96/00209

§ 371 Date: Mar. 12, 1998

§ 102(e) Date: Mar. 12, 1998

[87] PCT Pub. No.: WO96/37269

PCT Pub. Date: Nov. 28, 1996

[30] Foreign Application Priority Data

| | | | |
|---|---|---|---|
| May 24, 1995 | [NL] | Netherlands | 1000430 |
| Sep. 26, 1995 | [NL] | Netherlands | 1001284 |
| Jan. 11, 1996 | [NL] | Netherlands | 1002060 |

[51] Int. Cl.[7] ..... A63C 17/00

[52] U.S. Cl. ..... 280/11.15; 280/11.12

[58] Field of Search ..... 280/11.19, 11.27, 280/11.28, 11.12, 11.115, 841, 7.13, 7.14, 11.15, 11.16

[56] References Cited

U.S. PATENT DOCUMENTS

| | | | |
|---|---|---|---|
| 31,797 | 2/1861 | Gibson | 280/11.15 |
| 619,327 | 2/1899 | Miner | 280/11.15 |
| 1,228,544 | 6/1917 | Falstren et al. | 280/11.15 |
| 1,702,316 | 2/1929 | Ridgers | 280/11.15 |
| 3,749,413 | 7/1973 | Nicolson | 280/11.2 |
| 4,351,538 | 9/1982 | Berta | 280/11.28 |
| 5,588,774 | 12/1996 | Dentale | 280/11.28 |

FOREIGN PATENT DOCUMENTS

| | | | |
|---|---|---|---|
| 0192312 | 8/1996 | European Pat. Off. | A63C 1/28 |
| 2659534 | 9/1991 | France | A43B 5/16 |
| 811095 | 8/1951 | Germany . | |
| 8702068 | 4/1989 | Netherlands | A63C 1/02 |

*Primary Examiner*—Richard M. Camby

*Attorney, Agent, or Firm*—Webb Ziesenheim Logsdon Orkin & Hanson, P.C.

[57] ABSTRACT

The invention relates to a frame for a sporting device for coupling to a shoe, such as a ski which is slidable or rollable by means of wheels, in particular a cross-country ski, or a skate frame for an ice-skate or roller-skate, which frame comprises: an upper sub-frame with means for coupling to a shoe to be worn by a user, a lower sub-frame which is coupled via a pivot mechanism to said upper sub-frame for pivoting in a main plane and which is provided with or adapted to be provided with a runner or wheels; and a resetting spring for urging both sub-frames toward each other. The frame according to the invention has the special feature that the sub-frames are mutually pivotable and translatable in the said main plane. A specific embodiment has the feature that the sub-frames form part of a mechanism comprising at least four mutually pivotable and/or translatable rods.

29 Claims, 17 Drawing Sheets

2/1

3/1

3/2

3/3

4/1

4/2

4/3

4/4

4/5

4/6

5/5

5/6

6/1

6/2

SPORT DEVICE

BACKGROUND OF THE INVENTION

The invention relates to a frame for a sporting device for coupling to a shoe, such as a ski which is slidable or rollable by means of wheels, in particular a cross-country ski, or a skate frame for an ice-skate or roller-skate, which frame comprises:

an upper sub-frame with means for coupling to a shoe to be worn by a user;

a lower sub-frame which is coupled via a pivot mechanism to said upper sub-frame for pivoting in a main plane and which is provided with or adapted to be provided with a runner or wheels; and resetting spring means for urging both sub-frames toward each other.

Such a frame is known for a skate and has been commercially available for many years under the name tumble skate.

The object of such a variable construction is to make the force exerted by the skater on the ice or the ground as great as possible so as to thereby maximize the effectiveness of muscle power and the speed to be thus achieved.

It has been found that while the known skate has the advantage of a very simple construction it is not able to realize the stated objective.

An important cause of this technical deficiency of the known skate lies in the fact that both sub-frames are connected for mutual pivoting in a zone located in the region of the tip of the shoe. While a large pivot angle can thereby be realized, the force to be exerted has an effective point of engagement located so far from the front of the foot that an effective force transfer is illusory.

The invention has for its object to embody a skate frame such that the effectiveness of the force transfer is made as great as possible, on the one hand by choosing, optionally in variable manner, the effective point of engagement of the thrust forces during skating on the basis of physiological and ergonomic considerations and on the other by allowing the user to use the calf-muscles during skating, which is not the case with known, non-variable skates and which is the case to only very small, almost negligible extent with the described known tumble skate.

What is of great importance is that the frame allows the possibility of bending the foot in a manner which is similar to that in a walking movement. This is important for a stable thrust and for the best possible effective use of the relevant muscles. The prior art skates are not capable of this.

SUMMARY OF THE INVENTION

In respect of the above the frame according to the invention has the special feature that the sub-frames are mutually pivotable and translatable in the said main plane.

A specific embodiment has the feature that the sub-frames form part of a mechanism comprising at least four mutually pivotable and/or translatable (optionally theoretical) rods. It must be appreciated that the term "rod mechanism" as used above must be interpreted in a broad sense. A translation in a particular direction can for instance be seen as a rotation of an infinitely long rod extending in transverse direction of the translation.

The upper sub-frame can be embodied such that the position of the shoe relative to this upper sub-frame is adjustable. Longitudinal adjusting means can be present for this purpose.

A frame is recommended which has only one degree of freedom.

A degree of freedom is defined as a movement possibility of a mechanism or a connection which can be designated with only one variable, for instance the pivot angle an element can make round a hinged connection. In this case the degrees of freedom are defined in relation to the relative movement possibilities of the upper sub-frame and the lower sub-frame.

The other aspect of the invention relates to the fact that the frame has a (real or virtual) pole path. A pole path is the set of instantaneous centres of rotation or poles of the upper sub-frame relative to the lower sub-frame. Attention is drawn to the fact that for a well-defined pole path the frame may only have one degree of freedom.

The embodiment is recommended in which the pole path is substantially straight.

This latter variant can advantageously have the special feature that the pole path extends substantially horizontally.

At least for sporting devices with foot bending, this latter variant is preferably embodied such that the pole path extends between a starting position under the ball of the foot of a user in the rest position of the frame, and an end position under the big toe of the user in the extreme outward pivoted position of the frame.

The best results are obtained with an embodiment in which at constant relative angular speed of the sub-frames the speed of the pole along the pole path increases from the starting position to the end position. In preference the speed is initially substantially constant while the speed increases toward the end of the path.

A specific variant has the special feature that a frame is a member of the family in accordance with the table below, in which the first number designates the number of (optionally theoretical) rods, p1 designates the number of connections with one degree of freedom, p2 designates the number of connections with two degrees of freedom and # designates the presence of a well-defined pole path and therewith the suitability for a sporting device with foot bending:

| Family/member | Figure | p1 | p2 | suitable |
|---|---|---|---|---|
| 2/1 | 8 | 0 | 2 | # |
| 3/1 | 9 | 2 | 1 | |
| 3/2 | 10 | 1 | 1 | |
| 3/3 | 11 | 0 | 1 | |
| 4/1 | 12 | 4 | 0 | # |
| 4/2 | 13 | 4 | 0 | # |
| 4/3 | 14 | 3 | 2 | # |
| 4/4 | 15 | 2 | 4 | # |
| 4/5 | 16 | 1 | 6 | # |
| 4/6 | 17 | 0 | 8 | # |
| 5/1 | 18 | 5 | 1 | # |
| 5/2 | 19 | 4 | 3 | # |
| 5/3 | 20 | 3 | 5 | # |
| 5/4 | 21 | 2 | 7 | # |
| 5/5 | 22 | 1 | 9 | # |
| 5/6 | 23 | 0 | 11 | # |
| 6/1 | 24 | 7 | 0 | # |
| 6/2 | 25 | 6 | 2 | # |
| 6/3 | 26 | 5 | 4 | # |
| 6/4 | 27 | 4 | 6 | # |
| 6/5 | 28 | 3 | 8 | # |
| 6/6 | 29 | 2 | 10 | # |
| 6/7 | 30 | 1 | 12 | # |
| 6/8 | 31 | 0 | 14 | # |

A preferred choice of the available mechanisms provides a frame in which the frame comprises seven, eight, nine or ten pivot axes.

Probably the best compromise in respect of kinematic requirements, weight and simplicity is realized with a frame in which the frame comprises seven pivot axes.

All the stated criteria are satisfied with an embodiment in which the frame is constructed as according to FIG. 24 and (at least the relative) dimensioning according to FIG. 35.

In order to be able to withstand the very great forces which occur the frame must be mechanically very strong. It is particularly important for the frame to have torsional stiffness.

The following requirements can further be made of the frame for use in a skate with foot bending:

- the maximum height is about 30 mm. This maximum is determined by the space between the support tube for the runner and the shoe.
- the maximum length is about 150 mm. The heel support forms the criterion in this respect.
- the shafts forming the pivot axes may not be closer together than roughly 10 mm, since problems of strength might otherwise occur.

BRIEF DESCRIPTION OF THE SEVERAL VIEWS OF THE DRAWINGS

The invention will now be elucidated with reference to the annexed drawings. In the drawings.

DETAILED DESCRIPTION OF THE INVENTION

Figure 1A:
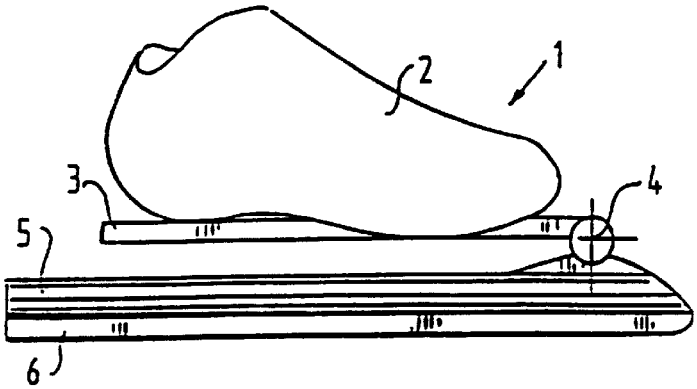
FIG.1A PRIOR ART
FIGS. 1A, B and C are prior art and show schematically a known tumble skate in three respective pivoting positions.
Figure 1B:
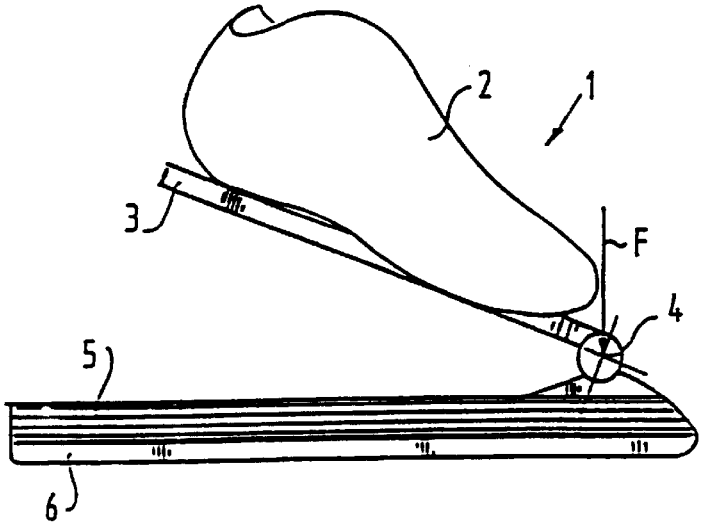
FIG.1B PRIOR ART
Figure 1C:
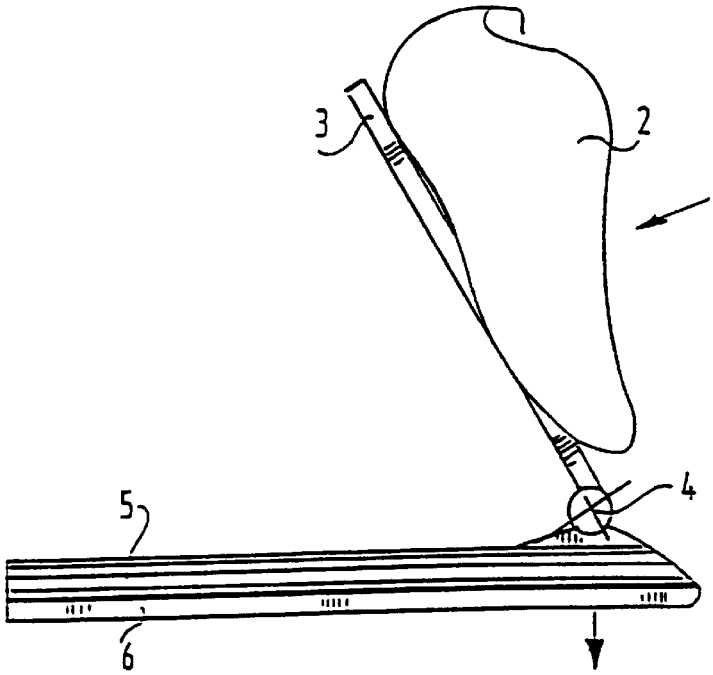
FIG.1C PRIOR ART

FIGS. 1A, 1B and 1C show schematically a known tumble skate 1 in respectively a rest position, an intermediate pivot position and an extreme pivot position. The skate comprises a shoe 2, an upper sub-frame 3 connected to the sole thereof, a lower sub-frame 5 in tubular form connected to sub-frame 3 at the front via a hinge 4 and a runner 6 arranged on sub-frame 5.

Figure 2A:
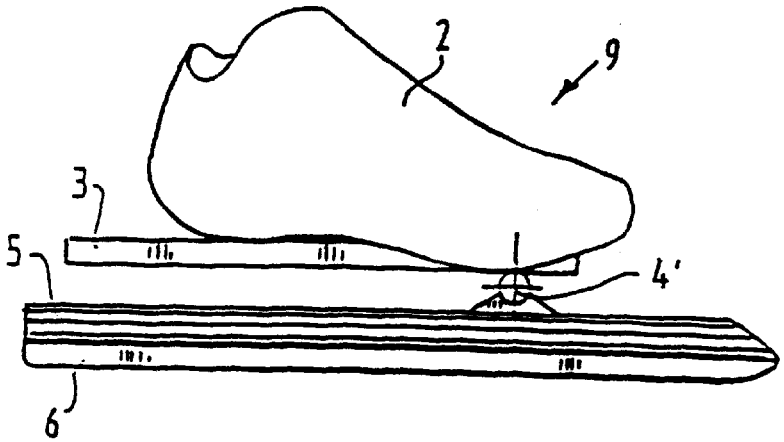
FIG.2A PRIOR ART
FIGS. 2A, B and C are prior art and show a possible variant of the known tumble skate, wherein the hinge is displaced to the rear, or under the ball of the foot.
Figure 2B:
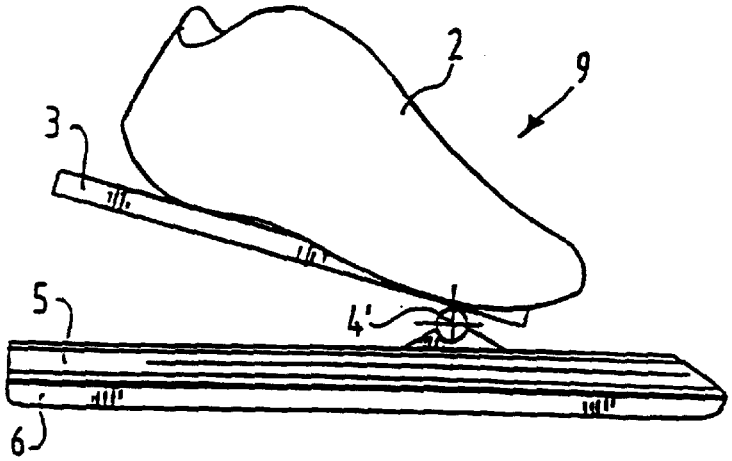
FIG.2B PRIOR ART
Figure 2C:
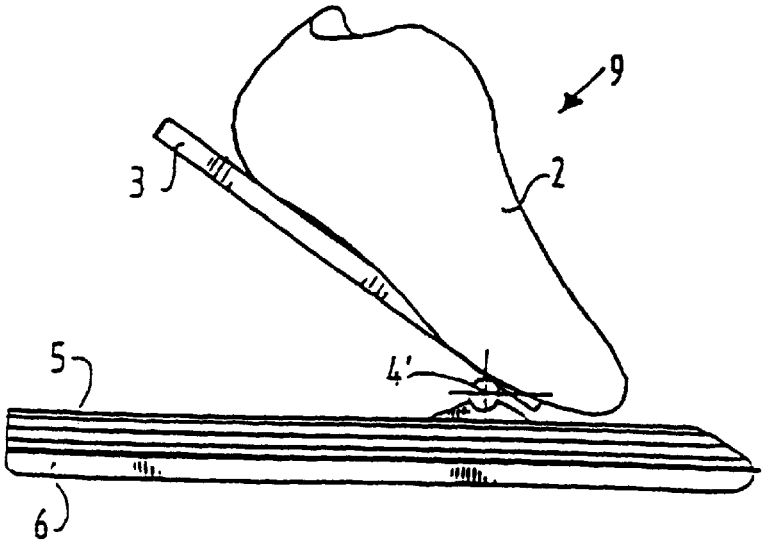
FIG.2C PRIOR ART

FIG. 2 shows a possible variant of skate 1. This skate 9 is modified in the sense that the axis of the hinge 4' lies further to the rear than that of hinge 4 according to FIG. 1. This could result in an improvement in respect of force transfer. The hinge 4' effectively lies roughly under the ball of the foot of a user. While a small improvement in the effectiveness of the force transfer can hereby be realized in combination with a simple construction, this embodiment has the drawback that the pivot angle is necessarily limited. This becomes particularly clear with reference to FIG. 2C.

It is noted generally that, where possible and appropriate, the same components are designated with the same reference numerals. This applies not only to identical components but also, and particularly, for functionally corresponding components.

Figure 3:
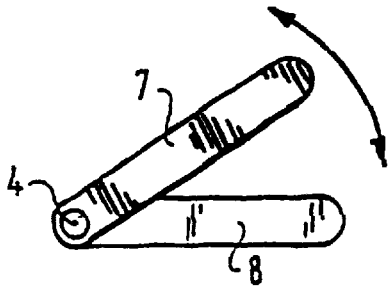
FIG.3 PRIOR ART
FIGS. 3, 4 and 5 are prior art and show in schematic side view three possible connections in the flat plane with one degree of freedom.

FIG. 3 shows a connection between two elements 7, 8 (corresponding respectively with upper sub-frame 3 and lower sub-frame 5). This connection in the flat plane has only one degree of freedom.

Figure 4:
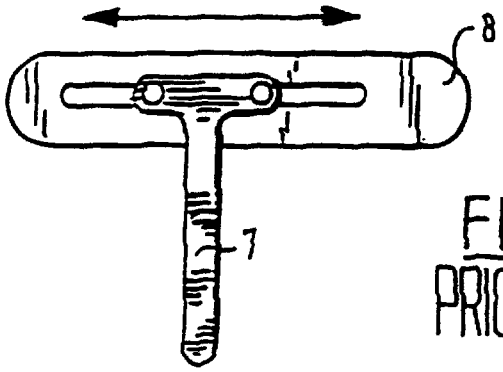
FIG.4 PRIOR ART

FIG. 4 likewise shows a connection between two elements 7, 8 with one degree of freedom. As the figure shows, these elements are mutually connected by a rectilinear guide so that they have only a degree of freedom of translation.

Figure 5:
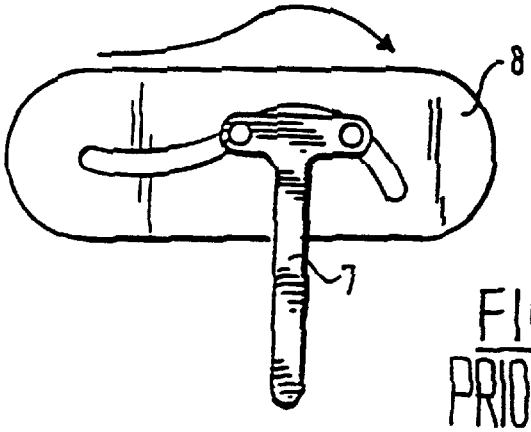
FIG.5 PRIOR ART

FIG. 5 shows a connection between elements 7 and 8 comprising a curve guide which effectively implies a hybrid of the hinge connection of FIG. 3 and the rectilinear guide of FIG. 4. It will be apparent that, despite there being only one degree of freedom, there is both a translation and a rotation.

Figure 6:
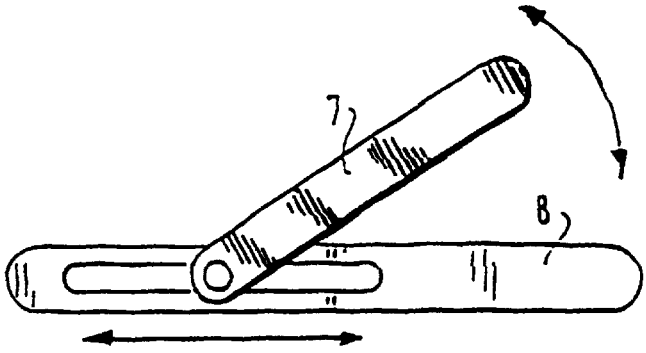
FIG.6 PRIOR ART
FIG. 6 is prior art and shows a connection in the flat plane with two degrees of freedom.

FIG. 6 shows an embodiment of a coupling between elements 7 and 8 with two degrees of freedom. This is a hinge in a guide path.

Figure 7A:
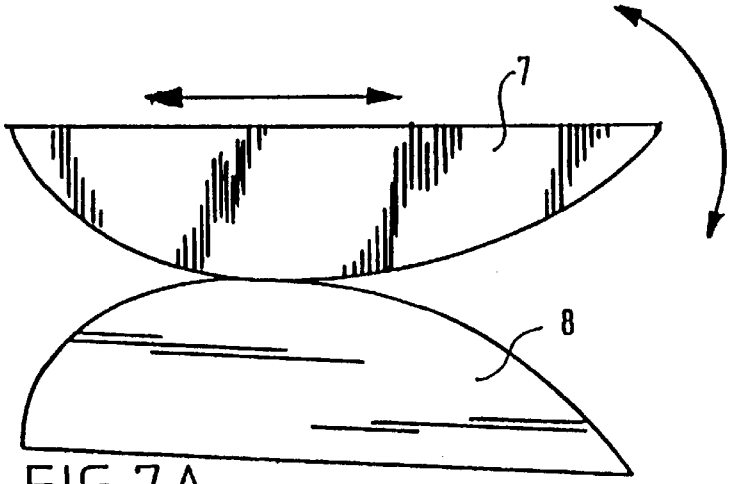
FIG. 7*a* shows schematically the contact between two profiles.

FIG. 7A shows the coupling between two profiles with both a translation and rotation degree of freedom.

Figure 7B:
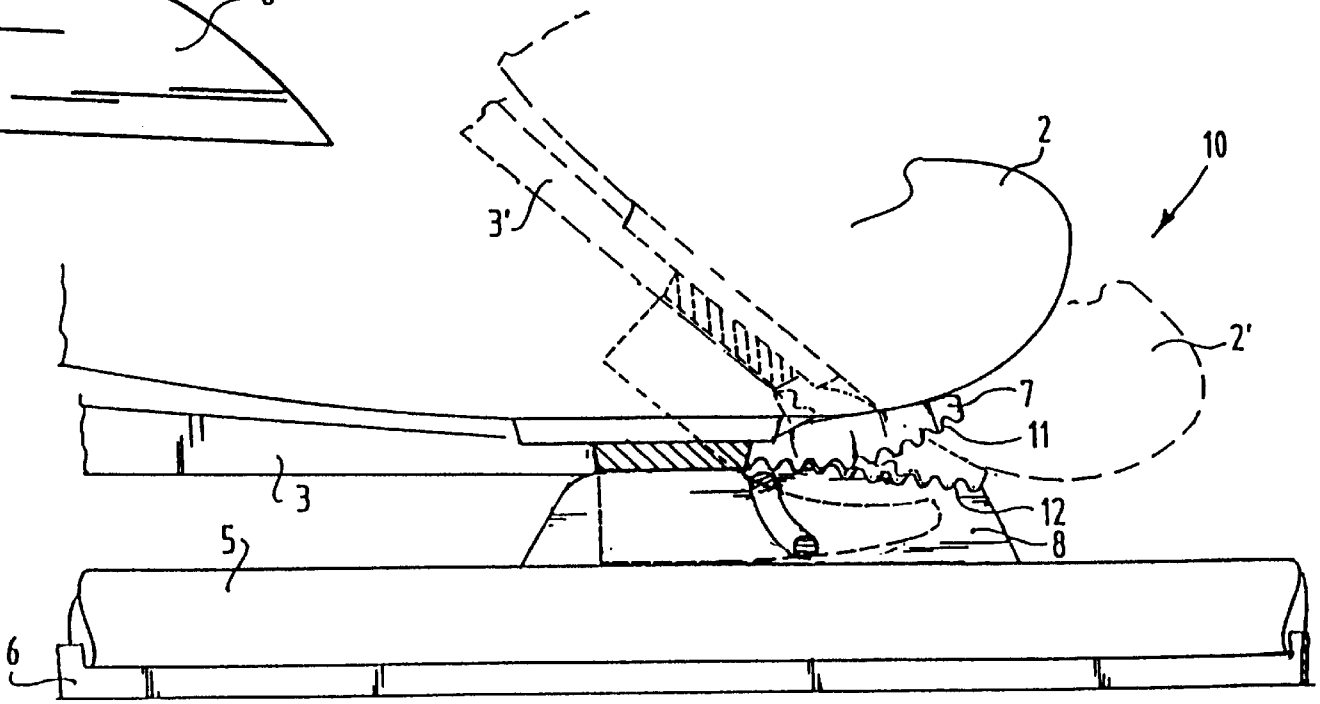
FIG. 7*b* shows a further developed embodiment of the connection of FIG. 7*a;*
Figure 8:
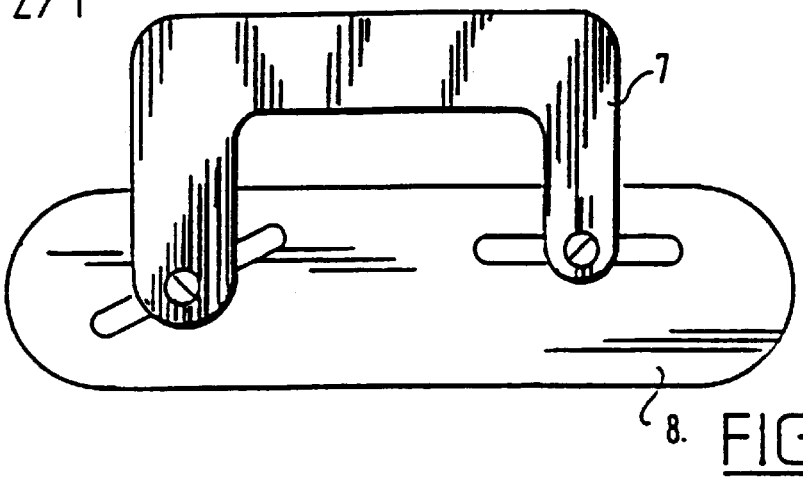
FIGS. 8–31 are schematic views of the family members of the table of claim 9.
Figure 9:
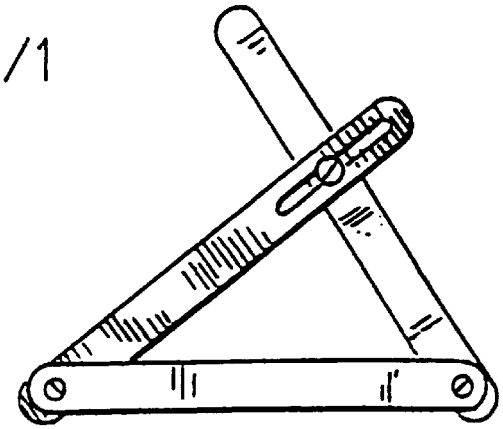
Figure 10:
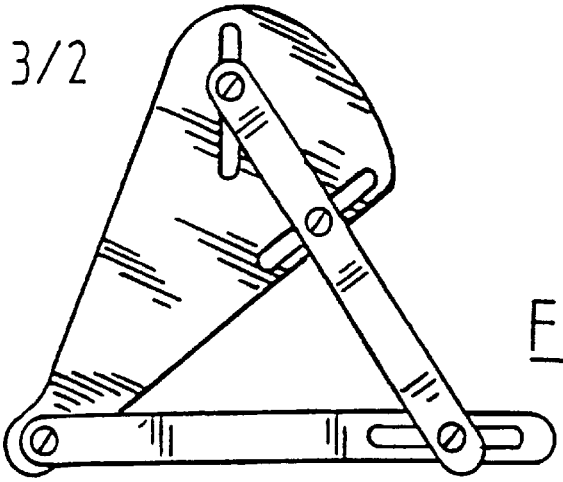
Figure 11:
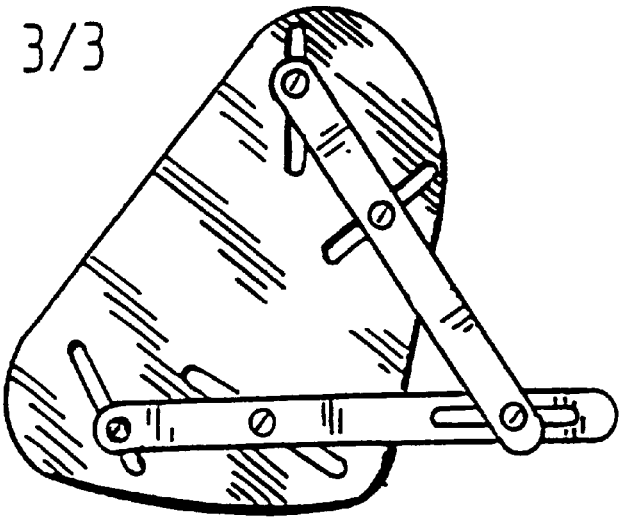
Figure 12:
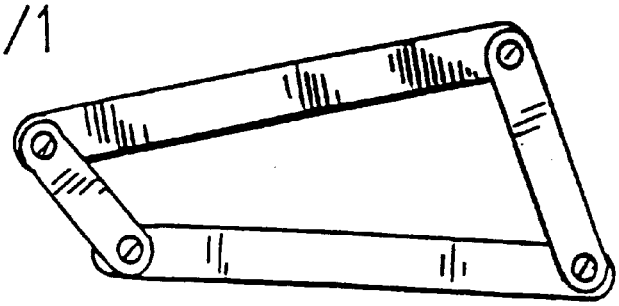
Figure 13:
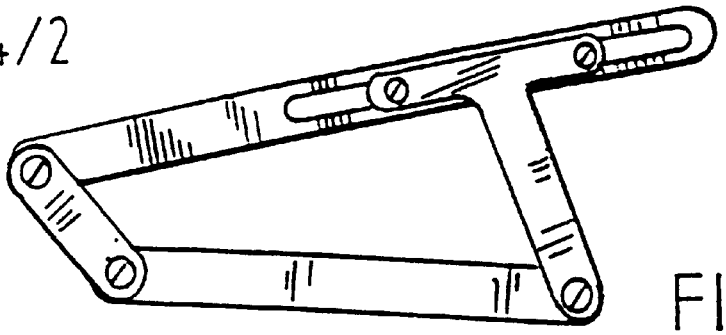
Figure 14:
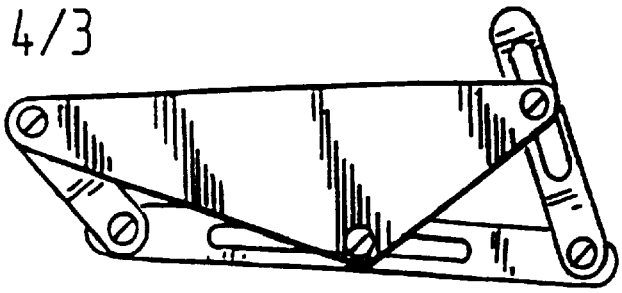
Figure 15:
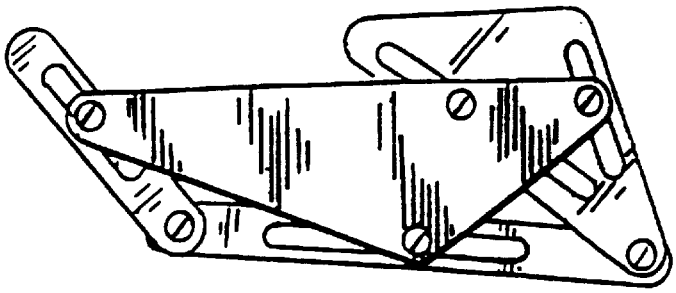
Figure 16:
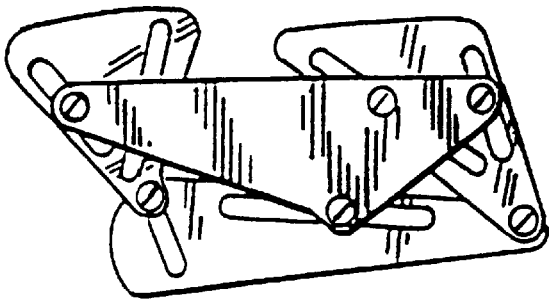
Figure 17:
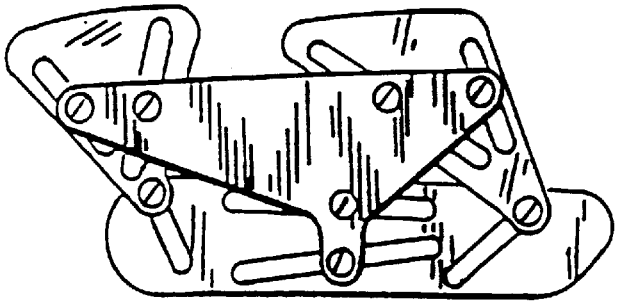
Figure 18:
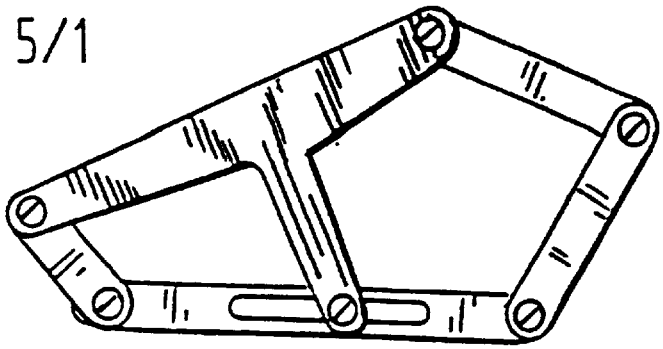
Figure 19:
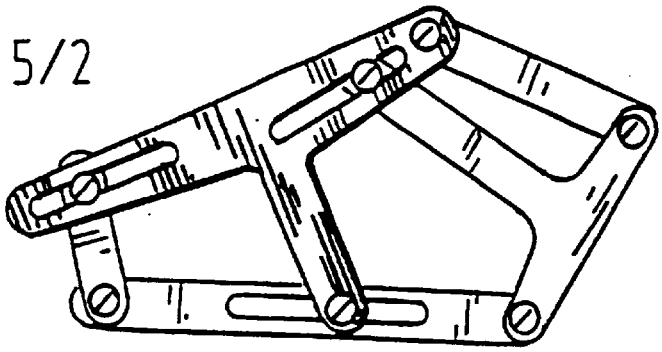
Figure 20:
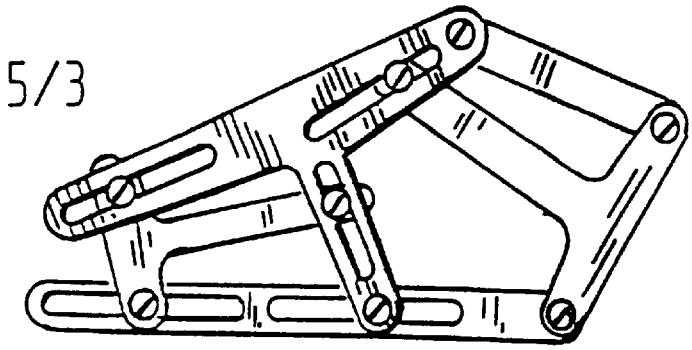
Figure 21:
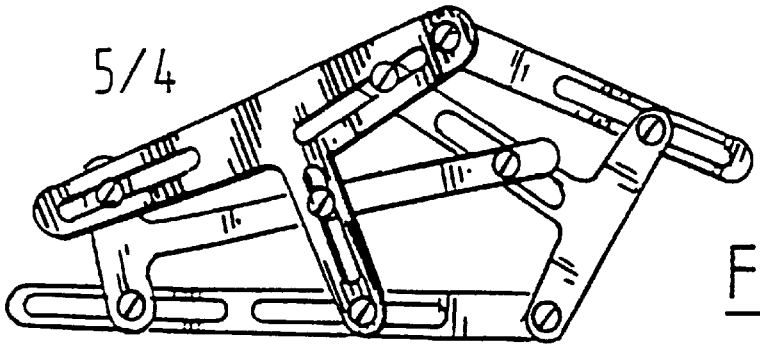
Figure 22:
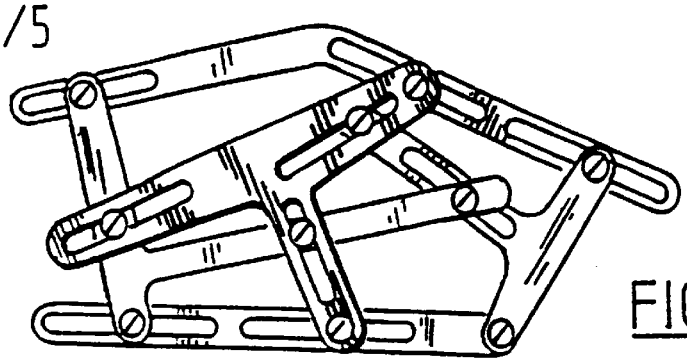
Figure 23:
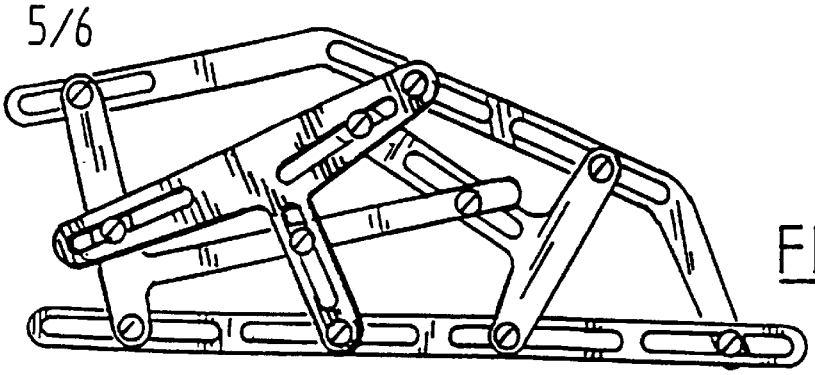

The skate 10 according to FIG. 7B comprises two mutually co-acting gear racks 11, 12 which form part of the respective elements 7, 8. It will be apparent that due to a displacement from the rest position designated with 2, 3 of shoe and upper sub-frame to the pivot position designated with 2', 3' both a rotation and a translation occur, wherein the centre of rotation follows a path corresponding with the rack 12. This is therefore a real pole path.

For a well-defined pole path the frame may have only one degree of freedom. It is pointed out once again that the invention relates exclusively to the degrees of freedom of the above mentioned elements 7 and 8, corresponding respectively to an upper sub-frame, which is or can be coupled to a shoe, and a lower sub-frame to which a runner, wheels, a ski-beam or the like is/are or can be connected.

FIGS. 8–31 show the family members as stated in the table included above.

Attention is drawn to the fact that, as already stated, the presence of a pole path is required for the devices applicable within the scope of the invention for sporting devices with foot bending. The embodiments of FIGS. 9, 10 and 11 therefore do not meet this requirement.

Figure 24:
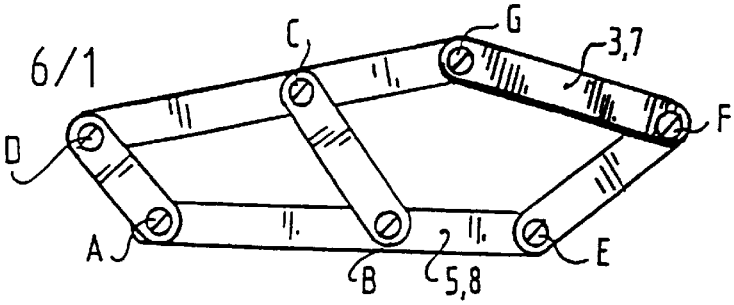
Figure 25:
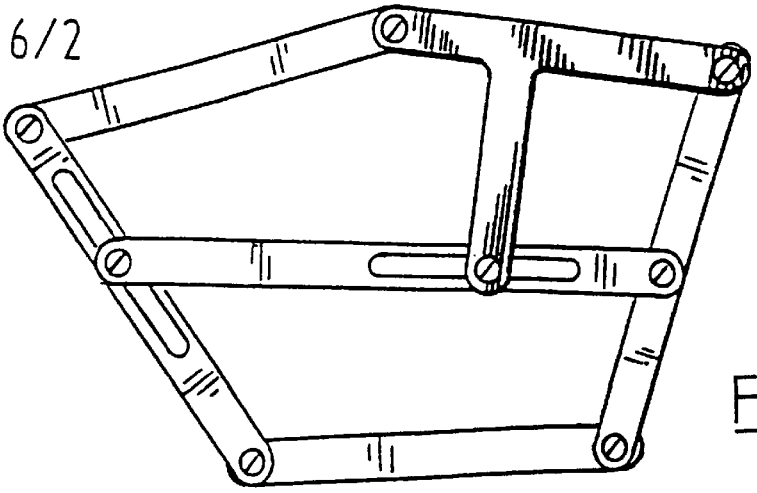
Figure 26:
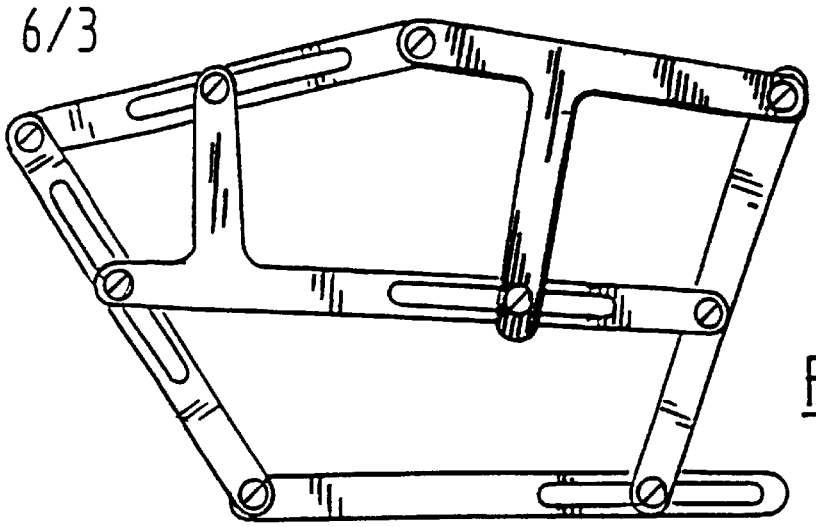
Figure 27:
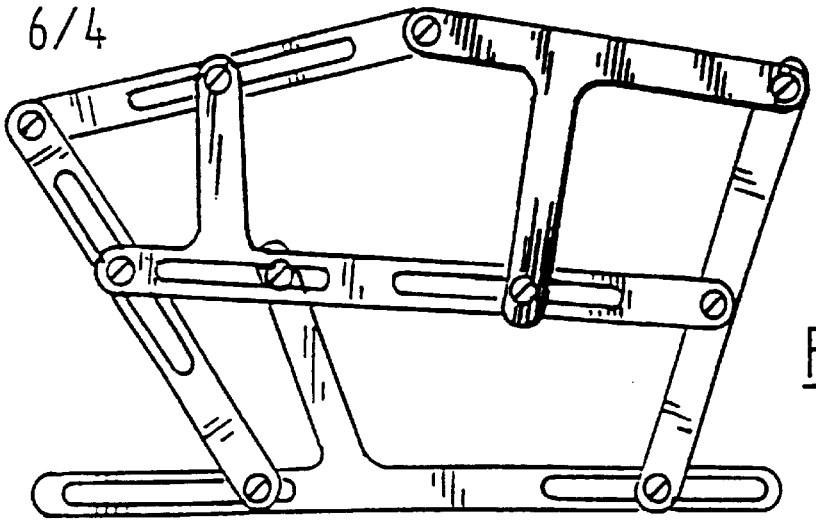
Figure 28:
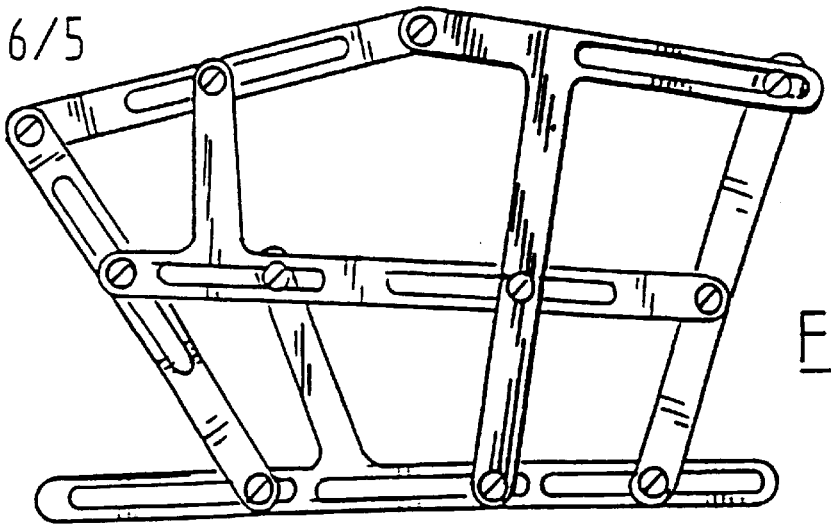
Figure 29:
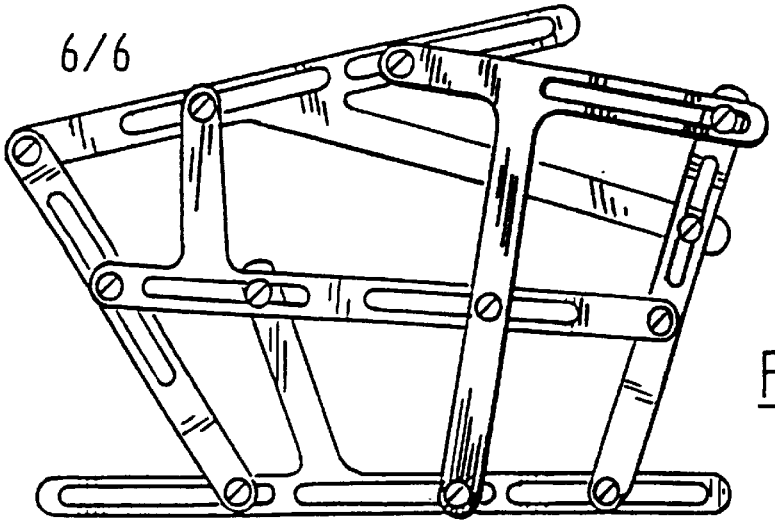
Figure 30:
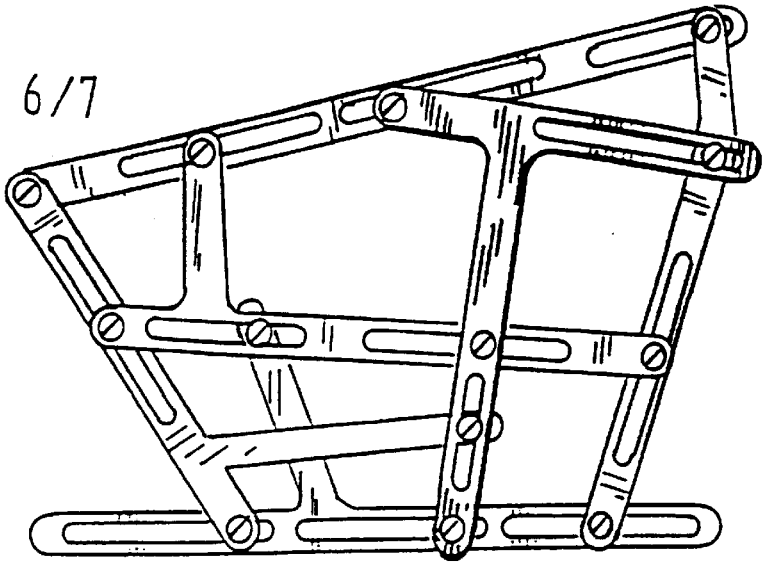
Figure 31:
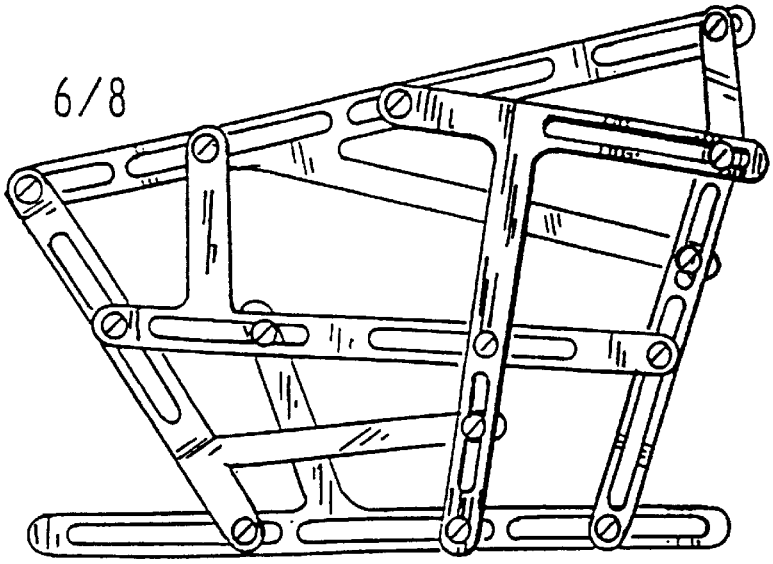

Of particular importance is the embodiment according to FIG. 24, family member 6/1. This embodiment comprises six rods and seven pivot axes. The principle sketched in FIG. 24 will be discussed below as a concrete example with reference to the preferred embodiment of the invention, i.e. with reference to FIGS. 32A, B, 33A, B, 34, 35 and 36.

In respect of the table shown and the associated FIGS. 8–31 it is noted that, in addition to the above mentioned families of rod mechanisms, families can also be formulated with more than six rods/elements per mechanism.

For each hinge connection in the above mentioned families a rectilinear guide can also be chosen.

For each hinge in a guide path a contact can also be chosen between two profiles, wherein it is noted with reference to FIG. 7A that load is not possible in all directions.

For each hinge in a guide path a curved guide path can also be chosen, which results in the pole path of an element being influenced.

The twenty-four mechanisms according to the FIGS. 8–31 and their variants as according to the comments above are not all equally suitable to satisfy the stringent requirements which can be made of the pole path of an element. The elements which are in principle suitable are designated with # in the table.

Rectilinear guides, curve guides and pivot guides are less capable in practice of holding the mechanism in the defined plane than simple hinges.

Experience with families of systems as specified above has demonstrated that with four hinges the stringent requirements for kinematics, weight, simplicity and well-defined pole path cannot be met. The requirements can be met in very close approximation with seven hinges, while with ten hinges the requirements can he satisfied virtually perfectly.

Partly with a view to a low weight, simplicity of construction and price, the mechanism according to FIG. 24, family member 6/1, is currently considered the most suitable. The following figures all relate thereto.

Figure 32A:
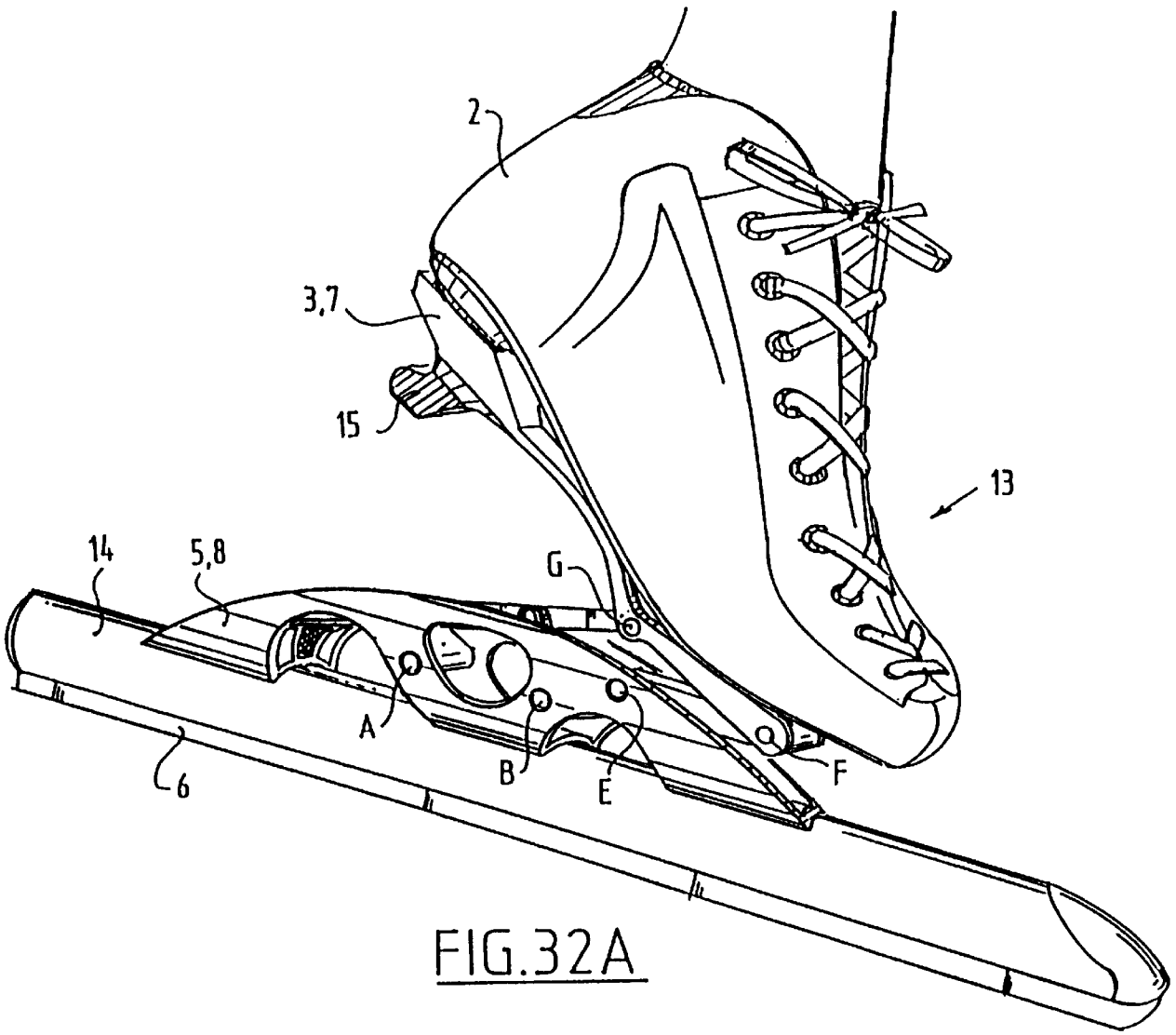
FIGS. 32A, B show perspective views in pivoted situation of a preferred frame as according to FIG. 24 (family member 6/1)
Figure 32B:
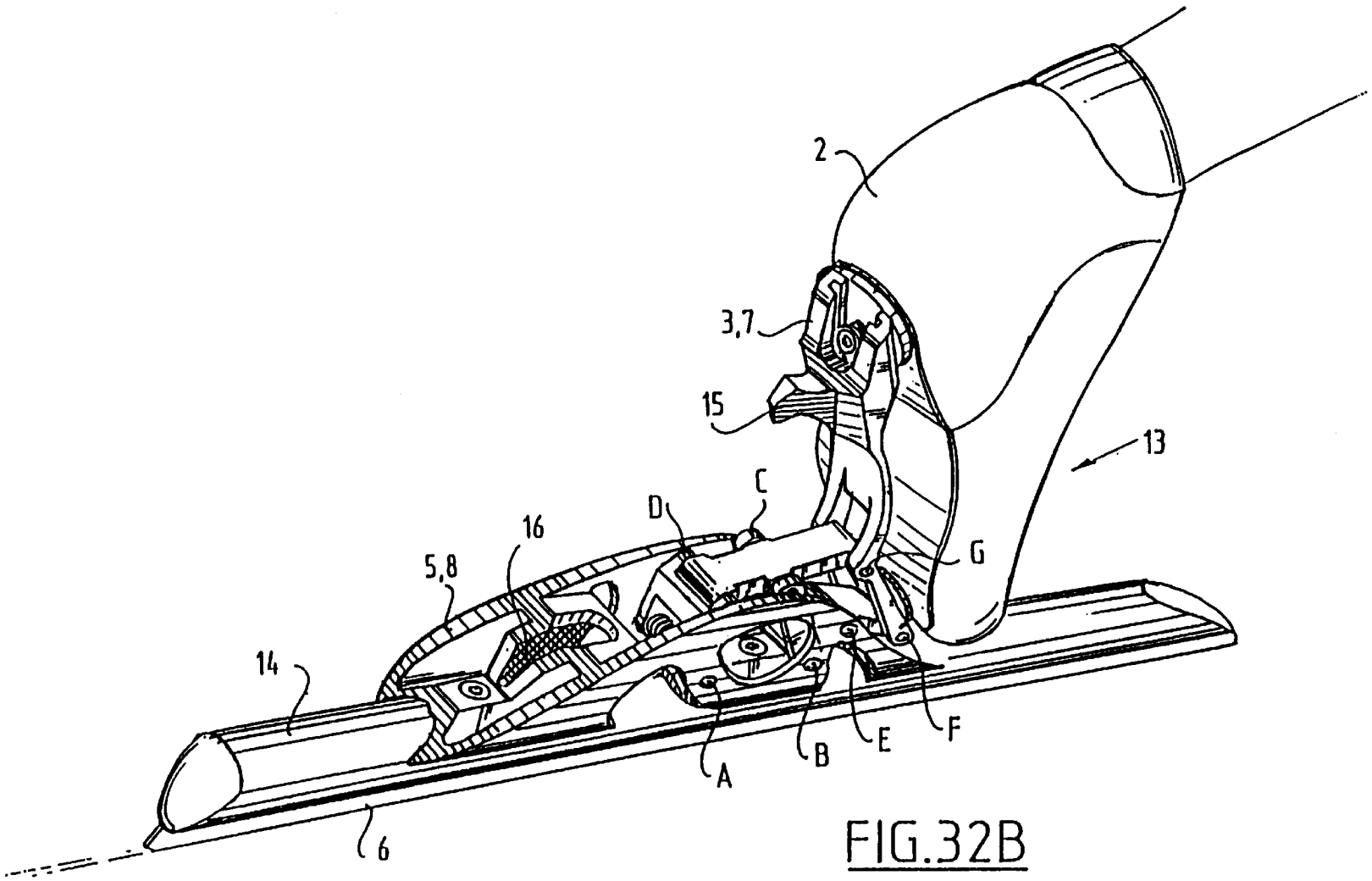

FIGS. 32A and B show a skate 13 based on the principle outlined in FIG. 24. Corresponding with FIG. 24, the upper sub-frame is designated with a double reference 3, 7 in order to make clear the functional relation between the upper sub-frame according to FIGS. 1 and 2 and the element 7 of FIG. 24. Similarly, the lower sub-frame is designated with 5, 8. It should be appreciated in this respect that the lower sub-frame 5, 8 is connected by screws to a tubular frame part 14 which bears the runner 6.

In FIGS. 32A and B, 33A, B and 34 are shown only the seven hinges A, B, C, D, E, F and G. The six rods are designated, insofar as necessary, with the relevant indications of these hinges. It will be apparent that the rod A B C is formed by the lower sub-frame 5, 8, 14, including the tubular frame part 14. The upper sub-frame G F is coupled to the sole of the shoe 2.

Figure 33A:
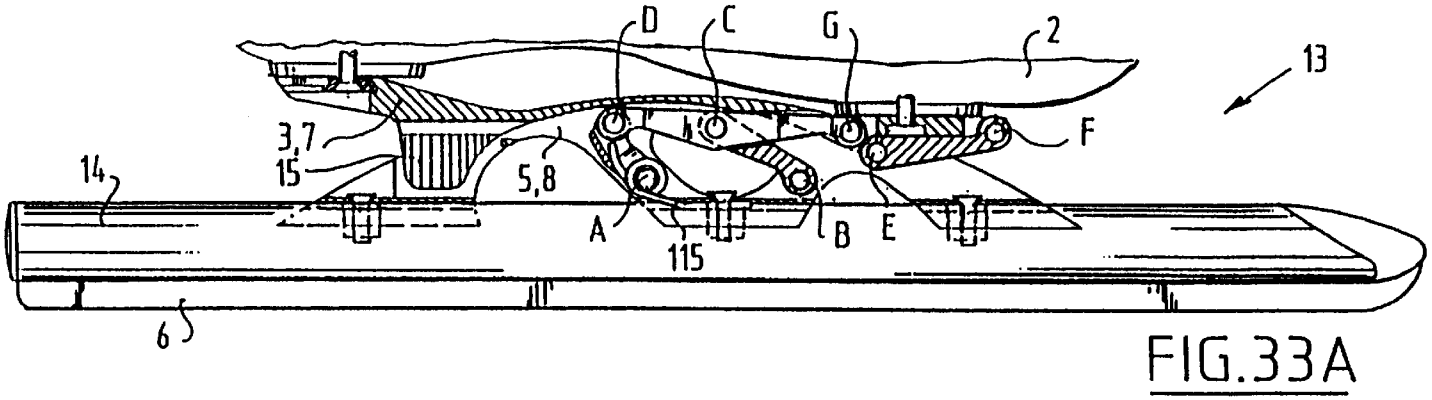
FIGS. 33A, B show the skate of FIG. 32, partly in side view, partly in lengthwise section, respectively in the rest position and the extreme pivot position of 48°.
Figure 33B:
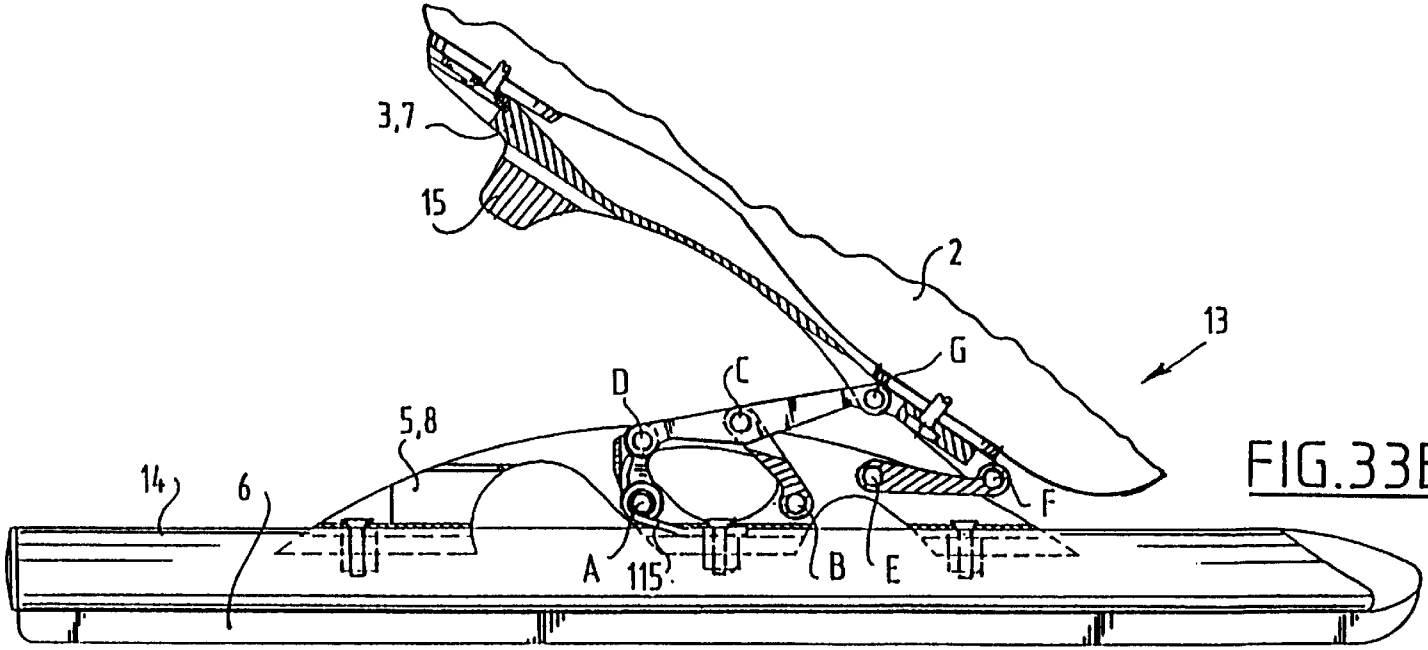
Figure 34:
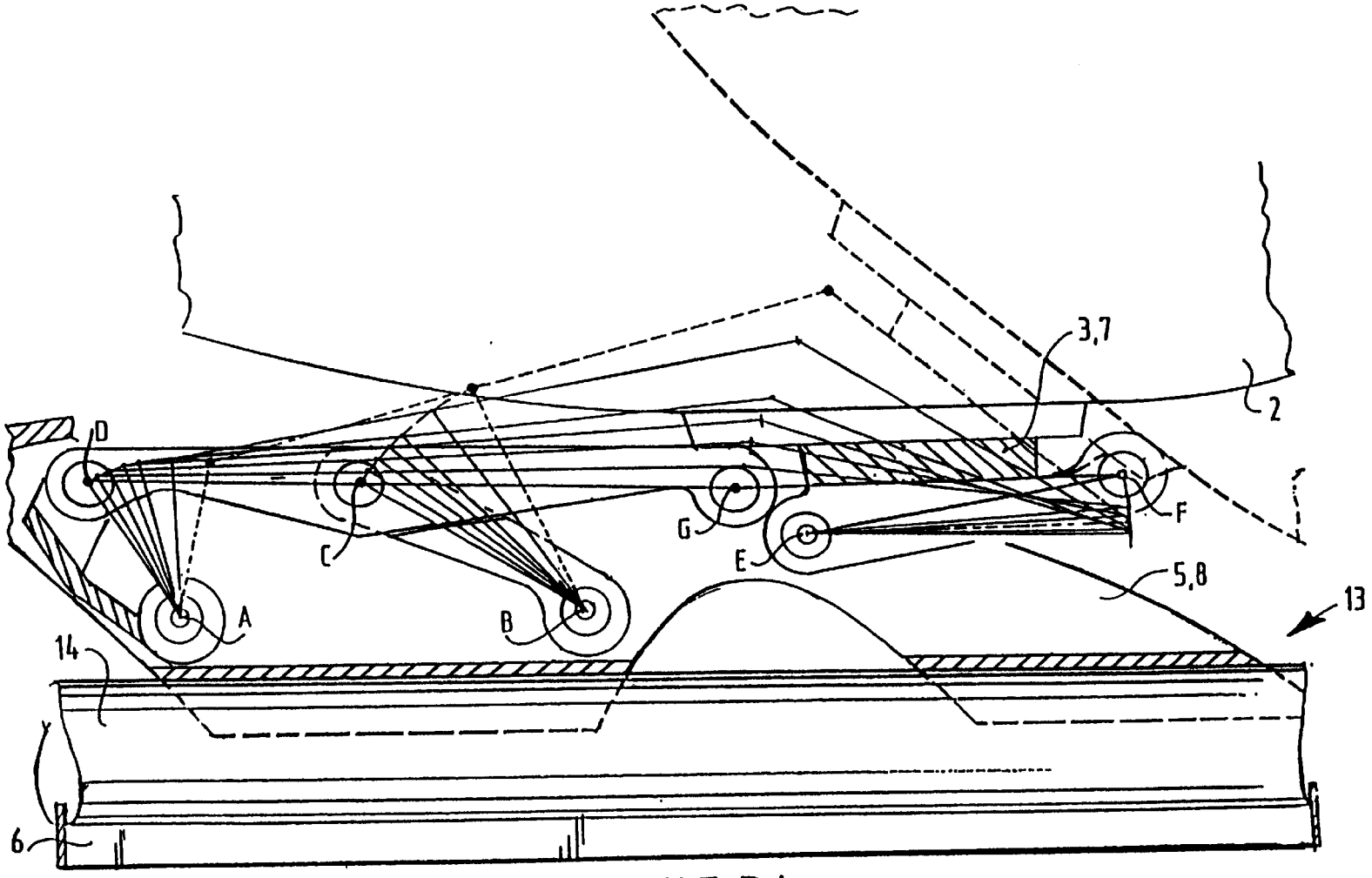
FIG. 34 is a diagram elucidating the structure of the skate according to FIGS. 32 and 33.

FIGS. 33A and B in particular show clearly the diverse positional changes during pivoting of the diverse rods and their hinges. FIG. 34 shows the position of FIG. 33A on large scale. Also drawn herein are the displacements of the hinges D, C, G and F during pivoting of the sub-frame 3, 7.

Figure 35:
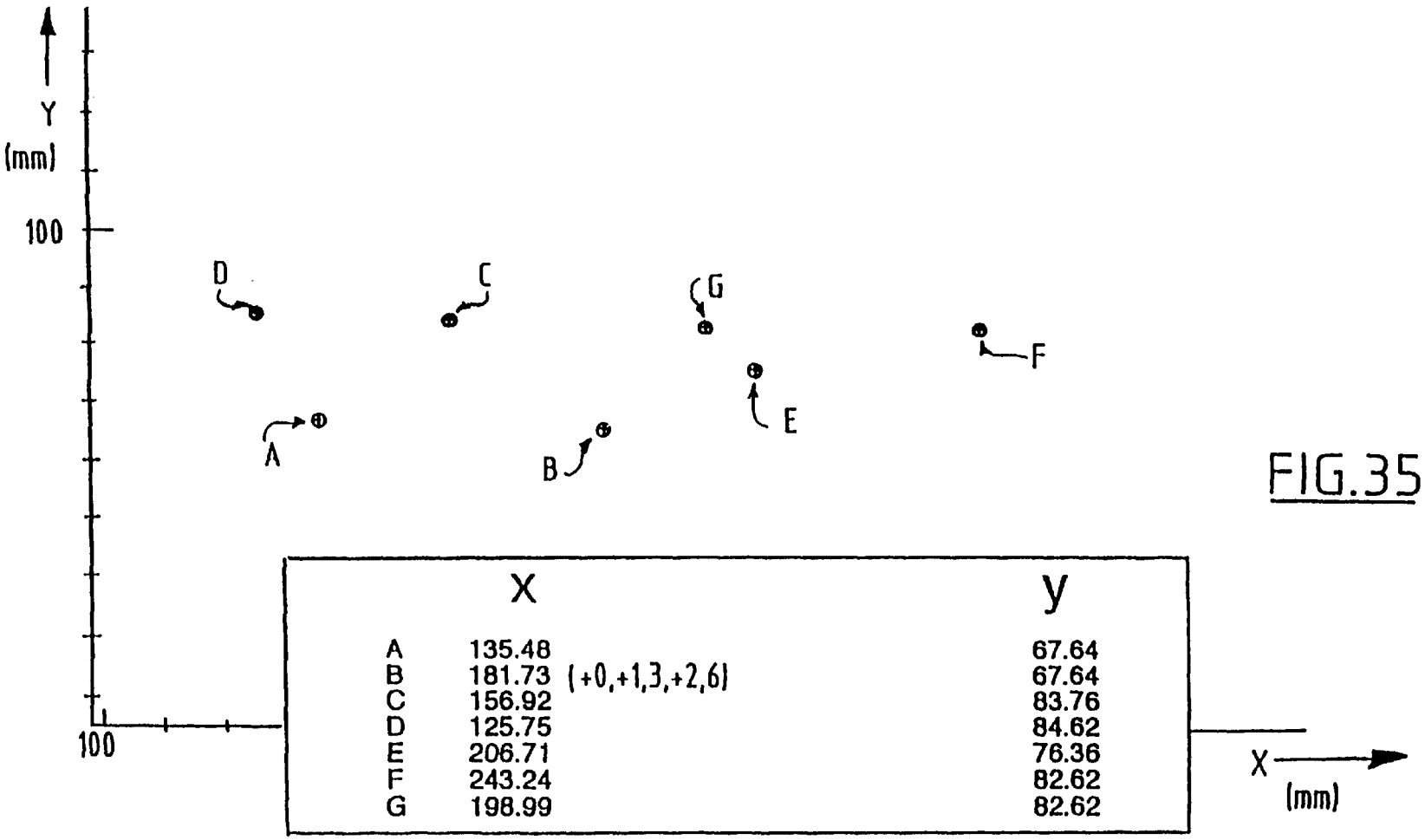
FIG. 35 is a graphic representation in cartesian coordinates of the locations of the pivot axes.

The above discussed pole path of sub-frame 3, 7, or the rod G F, runs, in accordance with the requirements to be made, practically entirely horizontally from below the ball of the foot to below the big toe of a user, provided the dimensioning specifications are complied with as shown in FIG. 35 and the table included therein.

In FIG. 35 the position of each hinge A, B, C, D, E, F, G is indicated in a Cartesian coordinate system. Attention is drawn to the fact that the X coordinate of the hinge B can have the indicated value or can display a certain positive deviation, depending on the shoe size of the user. Three shoe sizes can for instance be chosen, wherein the positive deviation relative to the given basic value amounts respectively to about 1.3 and 2.6 mm.

Attention is drawn to the fact that the origin of the coordinate system according to FIG. 35 is chosen randomly on the rear of the lower sub-frame 5, 8. Any other point of this sub-frame 5, 8 could have served as reference, for instance the hinge A. The dimensioning of the whole system A-G can be modified relative to for instance this hinge A, provided the ratios are preserved.

Figure 36:
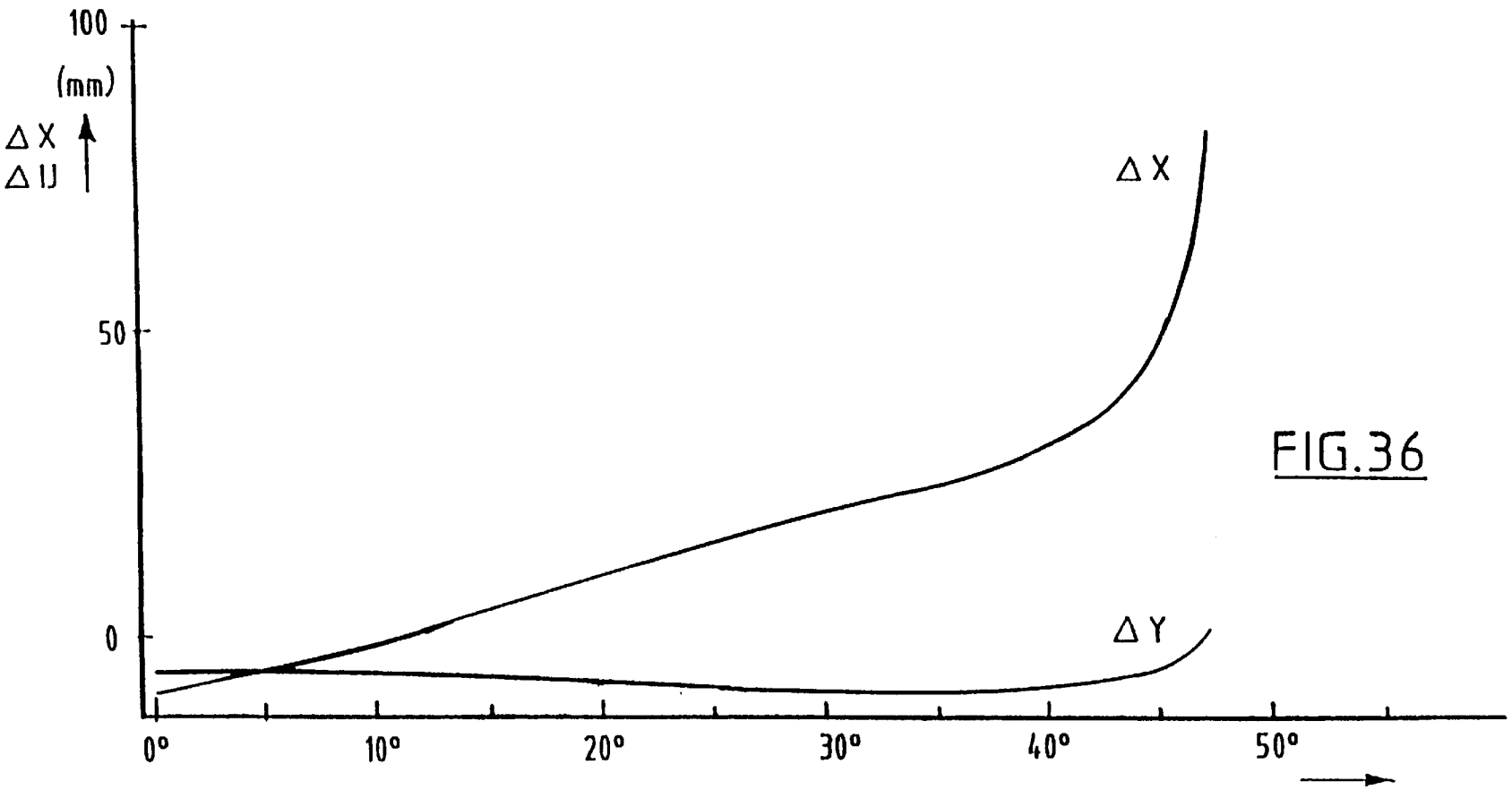
FIG. 36 shows the change in position in X and Y direction of the pole as a function of the pivot angle of the skate according to FIGS. 32–35.
Figure 3:
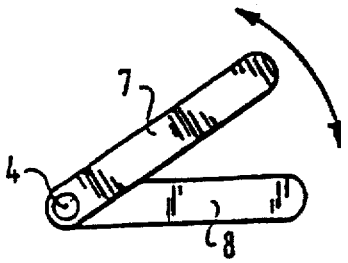
FIG.3 PRIOR ART
Figure 4:
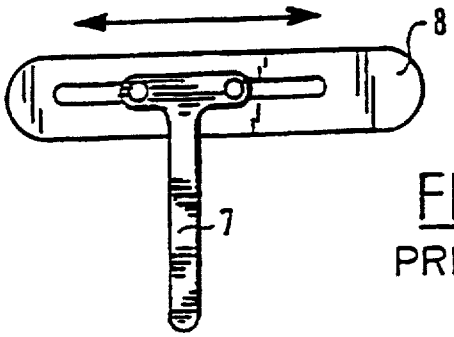
FIG.4 PRIOR ART
Figure 5:
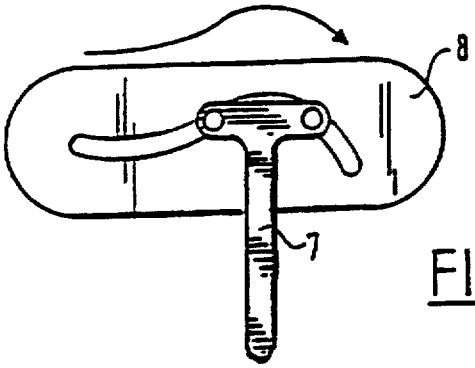
Figure 6:
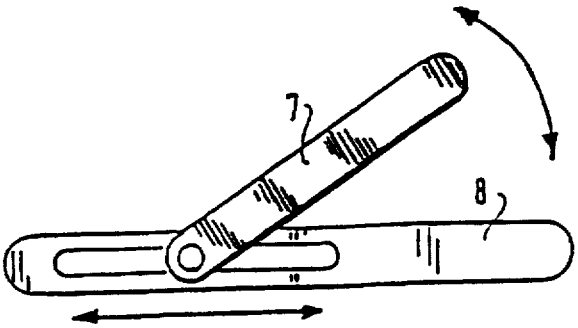

FIG. 36 shows in parameter presentation the pole path of the upper sub-frame 3, 7 relative to the lower sub-frame 5, 8. Shown horizontally is the pivot angle in degrees while in vertical direction is shown the positional change of the pivot centre in respectively X direction ($\Delta x$) and Y direction ($\Delta y$). The graph of FIG. 36 shows that the change $\Delta y$ in vertical direction amounts to a few millimetres and reaches roughly zero at the end of the pivot path corresponding with a pivot angle of about 48°.

The positional change of the pole in horizontal direction is designated with $\Delta x$. The speed is practically constant up to a of pivot angle of about 35°. After this distance the pole accelerates up to the end position.

Attention is once again drawn to the fact that at a pivot angle of zero the pole is situated roughly under the ball of the foot and at the end is situated under the big toe.

Attention is drawn to a resetting spring 115 embodied as helical torsion spring (see FIGS. 33A, B) which is arranged round the shaft of hinge A and exerts a resetting force between the rods ABE (see FIG. 24) and AD such that sub-frame 3, 7 is thereby urged to its rest position as shown in FIG. 33A where a heel element 15 can rest in a tapering stopper surface 16 which forms part of the lower sub-frame 5, 8 and which is covered with an elastic material to thus form a soft stop.

The lower sub-frame 5, 8 can be manufactured by starting from an extruded profile from which parts are removed selectively. All rods of the frame can very suitably be manufactured from aluminium. This material combines a low weight with sufficient strength. The hinges can be manufactured in per se known manner from very wear-resistant materials and combinations thereof.

Attention is drawn to the fact that the resetting spring means are not shown in all the figures. These can be very suitably embodied as a helical draw spring, a torsion spring or a spiral spring. A plurality of springs may also be active in the rod mechanism. The bias and stiffness of the spring means are determined by two considerations. On the one hand, during the inactive phase of a skating stroke, the lower sub-frame must be carried as quickly as possible to the upper sub-frame. On the other hand, the resetting force must not be so great that too considerable a part of the available force is absorbed by the spring means.

It is noted that the comparatively large pivot angle to be realized according to the invention of more than, optionally considerably more than, 20° corresponds with a natural unrolling of the movement of a foot.

The skate according to the invention makes optimal use of the possible rotation of the foot round the ankle. This mobility is designated plantar flexion and is essential for a good force transfer.

On the basis of the above very briefly stated considerations it can be anticipated that the skate frame according to the invention can result in essential speed increases.

We claim:

1. A frame for a sporting device for coupling to a shoe which frame comprises an upper sub-frame having a first rigid link with means for coupling to the shoe to be worn by a user, a lower sub-frame having a second rigid link which is coupled via pivoting and translating coupling means to said first rigid link for pivoting and translating in a main plane and upon which wheels or runners may be secured, and resetting spring means for urging both sub-frames toward each other; wherein the sub-frames are mutually pivotable and translatable in the said main plane along a predetermined pole path fixed by the coupling means.

2. The frame as claimed in claim 1, wherein the sub-frames form part of a mechanism comprising at least four rods interconnecting said upper sub-frame and said lower sub-frame permitting pivotal and translational motion between said sub-frames.

3. The frame as claimed in claim 1, wherein the frame has at least one degree of freedom.

4. The frame as claimed in claim 1, wherein the frame moves in accordance with the predetermined pole path fixed by the coupling means.

5. The frame as claimed in claim 4, wherein the pole path is substantially straight.

6. The frame as claimed in claim 4, wherein the pole path extends substantially horizontally.

7. The frame as claimed in claim 4, wherein the pole path extends between a starting position under the ball of the foot of a user in the rest position of the frame, and an end position under the big toe of the user in the extreme outward pivoted position of the frame.

8. The frame as claimed in claim 4, wherein at constant relative angular speed of the sub-frames the speed of the pole along the pole path increases from the starting position to the end position.

9. The frame as claimed in claim 4, wherein a frame is a member of the family in accordance with one of the configurations from the table below, in which the first number designates the number of rods, p1 designates the number of connections with one degree of freedom, p2 designates the number of connections with two degrees of freedom and # designates the presence of a well-defined pole path and therewith the suitability for a sporting device with foot bending:

| Family/member | Figure | p1 | p2 | suitable |
|---|---|---|---|---|
| 2/1 | 8 | 0 | 2 | # |
| 3/1 | 9 | 2 | 1 | |
| 3/2 | 10 | 1 | 1 | |
| 3/3 | 11 | 0 | 1 | |
| 4/1 | 12 | 4 | 0 | # |
| 4/2 | 13 | 4 | 0 | # |
| 4/3 | 14 | 3 | 2 | # |
| 4/4 | 15 | 2 | 4 | # |
| 4/5 | 16 | 1 | 6 | # |
| 4/6 | 17 | 0 | 8 | # |
| 5/1 | 18 | 5 | 1 | # |
| 5/2 | 19 | 4 | 3 | # |
| 5/3 | 20 | 3 | 5 | # |
| 5/4 | 21 | 2 | 7 | # |
| 5/5 | 22 | 1 | 9 | # |
| 5/6 | 23 | 0 | 11 | # |
| 6/1 | 24 | 7 | 0 | # |
| 6/2 | 25 | 6 | 2 | # |
| 6/3 | 26 | 5 | 4 | # |
| 6/4 | 27 | 4 | 6 | # |
| 6/5 | 28 | 3 | 8 | # |
| 6/6 | 29 | 2 | 10 | # |
| 6/7 | 30 | 1 | 12 | # |
| 6/8 | 31 | 0 | 14 | #. |

10. The frame as claimed in claim 9, wherein the frame comprises between seven and ten pivot axes.

11. The frame as claimed in claim 10, wherein the frame comprises seven pivot axes.

12. The frame as claimed in claim 1, wherein the upper sub-frame is attached to a skate frame.

13. The frame as claimed in claim 1, wherein the frame has torsional stiffness.

14. A frame for a sporting device for coupling to a shoe which frame comprises an upper sub-frame with means for coupling to the shoe to be worn by a user, a lower sub-frame which is coupled via a pivot mechanism to said upper sub-frame for pivoting in a main plane and which is provided with or adapted to be provided with a runner or wheels, and resetting spring means for urging both sub-frames toward each other, wherein the sub-frames are mutually pivotable and translatable in the said main plane, and wherein the upper sub-frame is attached to a ski, which is slidable or rollable by means of wheels.

15. The frame according to claim 14, wherein the ski is a cross-country ski.

16. The frame according to claim 12, wherein the skate frame is for an ice-skate.

17. The frame according to claim 12, wherein the skate frame is for a roller-skate.

18. A frame for a sporting device for coupling to a shoe which frame comprises an upper sub-frame having a first rigid link with means for coupling to the shoe to be worn by a user, a lower sub-frame having a second rigid link which is coupled to said first rigid link defining a linkage for motion in a main plane and upon which wheels or runners may be secured, and resetting spring means for urging both sub-frames toward each other; wherein the sub-frames are mutually pivotable and translatable relative to one another in the said main plane along a predetermined pole path fixed by the linkage.

19. The frame as claimed in claim 18, wherein the sub-frames form part of a mechanism comprising at least four rods interconnecting said upper sub-frame and said lower sub-frame permitting pivotal and translational motion between said sub-frames.

20. The frame as claimed in claim 18, wherein the frame has only one degree of freedom.

21. The frame as claimed in claim 18, wherein the framed moves in accordance with the predetermined pole path fixed by the coupling means.

22. The frame as claimed in claim 21, wherein the pole path is substantially straight.

23. The frame as claimed in claim 21, wherein the pole path extends substantially horizontally.

24. The frame as claimed in claim 21, wherein the pole path extends between a starting position under the ball of the foot of a user in the rest position of the frame, and an end position under the big toe of the user in the extreme outward pivoted position of the frame.

25. The frame as claimed in claim 21, wherein at constant relative angular speed of the sub-frames the speed of the pole along the pole path increases from the starting position to the end position.

26. The frame as claimed in claim 21, wherein a frame is a member of the family in accordance with one of the configurations from the table below, in which the first number designates the number of rods, p1 designates the number connections with one degree of freedom, p2 designates the number of connections with two degrees of freedom and # designates the presence of a well-defined pole path and therewith the suitability for a sporting device with foot bending:

| Family/member | Figure | p1 | p2 | suitable |
|---|---|---|---|---|
| 2/1 | 8 | 0 | 2 | # |
| 3/1 | 9 | 2 | 1 | |

-continued

| Family/member | Figure | p1 | p2 | suitable |
|---|---|---|---|---|
| 3/2 | 10 | 1 | 1 | |
| 3/3 | 11 | 0 | 1 | |
| 4/1 | 12 | 4 | 0 | # |
| 4/2 | 13 | 4 | 0 | # |
| 4/3 | 14 | 3 | 2 | # |
| 4/4 | 15 | 2 | 4 | # |
| 4/5 | 16 | 1 | 6 | # |
| 4/6 | 17 | 0 | 8 | # |
| 5/1 | 18 | 5 | 1 | # |
| 5/2 | 19 | 4 | 3 | # |
| 5/3 | 20 | 3 | 5 | # |
| 5/4 | 21 | 2 | 7 | # |
| 5/5 | 22 | 1 | 9 | # |
| 5/6 | 23 | 0 | 11 | # |
| 6/1 | 24 | 7 | 0 | # |
| 6/2 | 25 | 6 | 2 | # |
| 6/3 | 26 | 5 | 4 | # |

-continued

| Family/member | Figure | p1 | p2 | suitable |
|---|---|---|---|---|
| 6/4 | 27 | 4 | 6 | # |
| 6/5 | 28 | 3 | 8 | # |
| 6/6 | 29 | 2 | 10 | # |
| 6/7 | 30 | 1 | 12 | # |
| 6/8 | 31 | 0 | 14 | #. |

27. The frame as claimed in claim 26, wherein the frame comprises between seven and ten pivot axes.

28. The frame as claimed in claim 27, wherein the frame comprises seven pivot axes.

29. The frame as claimed in claim 18, wherein the linkage has a plurality of rods.

* * * * *

UNITED STATES PATENT AND TRADEMARK OFFICE

CERTIFICATE OF CORRECTION

PATENT NO. : 6,113,111
DATED : September 5, 2000
INVENTOR(S) : Johan Gierveld et al.

It is certified that error appears in the above-identified patent and that said Letters Patent is hereby corrected as shown below:

In the Drawings,
Please substitute the attached Sheet 3 of 17 for that of Sheet 3 in the patent.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*